US011465793B2

(12) United States Patent
Herman

(10) Patent No.: US 11,465,793 B2
(45) Date of Patent: Oct. 11, 2022

(54) BAG CLOSURE APPLYING UNIT AND BAG CLOSURE DEVICE WITH SUCH BAG CLOSURE APPLYING UNIT

(71) Applicants: Freek Arie Herman, Leek (NL); Martine Marie Yvonne Herman-Wouters, Leek (NL)

(72) Inventor: Freek Arie Herman, Leek (NL)

(73) Assignee: Martine Marie Yvonne Herman-Wouters, Leek (NL)

( * ) Notice: Subject to any disclaimer, the term of this patent is extended or adjusted under 35 U.S.C. 154(b) by 0 days.

(21) Appl. No.: 16/912,142

(22) Filed: Jun. 25, 2020

(65) Prior Publication Data

US 2021/0403192 A1 Dec. 30, 2021

(51) Int. Cl.
*B65B 51/04* (2006.01)

(52) U.S. Cl.
CPC ..... *B65B 51/046* (2013.01); *B65B 51/043* (2013.01)

(58) Field of Classification Search
CPC ..... B65B 1/04; B65B 1/043; B65B 1/046
See application file for complete search history.

(56) References Cited

U.S. PATENT DOCUMENTS 3,131,398 A * 5/1964 Gohring ..... B65B 51/04 29/243.57
3,270,481 A * 9/1966 Rocholl ..... B65B 51/043 53/481
4,999,969 A * 3/1991 Holmes ..... B65B 51/043 53/138.3
5,485,711 A * 1/1996 Suzuki ..... B65B 51/043 53/138.4
6,453,640 B1 * 9/2002 Hayashi ..... B65B 51/043 53/138.3
2005/0081488 A1 * 4/2005 Drunen ..... B65D 33/1625 53/138.3
2006/0101787 A1 * 5/2006 Hartmann ..... B65B 51/043 53/138.3
2011/0079123 A1 * 4/2011 Irwin ..... B26D 1/305 83/42

FOREIGN PATENT DOCUMENTS

DE 2010447 A1 9/1971
EP 0018205 A1 10/1980
GB 1328146 A 8/1973

* cited by examiner

*Primary Examiner* — Anna K Kinsaul
*Assistant Examiner* — Luis G Del Valle
(74) *Attorney, Agent, or Firm* — Workman Nydegger

(57) ABSTRACT

A bag closure applying unit is provided for attaching a bag closure, for example, a "Kwik Lok" type and/or "Schutte" type of bag closure, to a bag. The bag closure applying unit includes an elongated housing having a first end and a second end, opposite to the first end, and a guiding channel extending between the first end and the second end. The guiding channel is configured for receiving a strip of bag closures. The bag closure applying unit further includes a moving mechanism configured for engaging the strip of bag closures and for moving the strip of bag closures through the guiding channel. The moving mechanism includes two engaging arms for engaging the strip of bag closures. The engaging arms are configured to engage the strip of bag closures at the longitudinal sides thereof.

28 Claims, 6 Drawing Sheets

BAG CLOSURE APPLYING UNIT AND BAG CLOSURE DEVICE WITH SUCH BAG CLOSURE APPLYING UNIT

BACKGROUND

The invention relates to a bag closure applying unit for attaching a bag closure to a bag. Furthermore, the invention relates to a bag closure device having a bag closure applying unit according to the invention.

Such a bag closure device is known from the Kwik Lok corporation offering a semiautomatic bag closing machine. The semiautomatic bag closing machine comprises an elongated housing having a first end and a second end, opposite to the first end, and a guiding channel extending between the first end and the second end, wherein the guiding channel is configured for receiving a strip of bag closures; and a moving mechanism configured for engaging the strip of bag closures and for moving the strip of bag closures in a direction extending between the first end and the second end of the elongated housing. The moving mechanism comprises a fork-shaped engaging member for engaging the strip of bag closures from below. The moving mechanism further comprises several spring-suspended components for enabling the moving mechanism to function.

SUMMARY OF THE INVENTION

A disadvantage of the known semiautomatic bag closing device is that because of the fork-shaped engaging member engaging the strip of bag closures from below, the fork-shaped engaging member needs a relatively large space in order to be able to perform the requested motion.

A further disadvantage of the known semiautomatic bag closing machine is that the machine is sensitive to displacement thereof. Displacement of the machine causes the spring-suspended components to move undesirably within the machine, which might cause the machine to no longer function properly. Furthermore, the spring tensions are very important for proper functioning of the semiautomatic bag closing machine.

It is an object of the present invention to ameliorate or to eliminate one or more disadvantages of the known semiautomatic bag closing machine, to provide an improved semiautomatic bag closing machine or to at least provide an alternative semiautomatic bag closing machine.

According to a first aspect, the invention provides a bag closure applying unit for attaching a bag closure, in particular a "Kwik Lok" type and/or "Schutte" type of bag closure, to a bag, wherein the bag closure applying unit comprises:

an elongated housing having a first end and a second end, opposite to the first end, and a guiding channel extending between the first end and the second end and ending at or in a dispensing position for dispensing a bag closure, wherein the guiding channel is configured for receiving a strip of bag closures; and a moving mechanism configured for engaging the strip of bag closures and for moving the strip of bag closures through the guiding channel towards the dispensing position, wherein the moving mechanism comprises an engaging arm for engaging the strip of bag closures, wherein the engaging arm is configured to engage the strip of bag closures at a longitudinal side thereof.

During use of the bag closure applying unit, the engaging arm is used for moving the strip of bag closures through the guiding channel and towards the dispensing position, such that at least one bag closure is arranged at the dispensing position. In order to move the strip of bag closures through the guiding channel towards the dispensing position, the engaging arm engages the strip of bag closures at one of the longitudinal sides thereof, the longitudinal sides being the sides of the strip of bag closures in which notches/indentations are provided at a transition between consecutive bag closures, which during use are substantially parallel to the guiding channel of the elongated housing and/or within a plane defined by the guiding channel. Since the engaging arm engages the strip of bag closures at the longitudinal side thereof and thus move at least partially within the same plane as within which the strip of bag closures is moved, less space is needed for arranging the moving mechanism. Therefore, the bag closure applying unit can be more compact in comparison with the known semiautomatic bag closing machine.

In the context of the present application, it is noted that each bag closure of the strip of bag closures has a narrow forward opening connecting with a heart-shaped closure aperture forming jaws preventing escape of a bag neck forced through the opening into the heart-shaped closure aperture. Furthermore, the strip of bag closures has a triangular shaped indentation in each of the longitudinal sides of the strip of bag closures at each transition between subsequent bag closures.

In an embodiment, the moving mechanism comprises two engaging arms. During use, the engaging arms engage the strip of bag closures at the longitudinal sides thereof, the longitudinal sides being the sides of the strip of bag closures in which notches/indentations are provided at a transition between consecutive bag closures. Therefore, the engaging arms can be used for engaging both longitudinal sides of a strip of bag closures during moving the strip of bag closures through the guiding channel. An advantage of this embodiment is that, due to the strip of bag closures being engaged at both longitudinal sides, the strip of bag closures is prevented from getting positioned obliquely in the channel which may result in the strip of bag closures getting stuck within the guiding channel.

In an embodiment, the engaging arms are configured to be moved between a first position, in which the two engaging arms have engaged the strip of bag closures, and a second position, in which the two engaging arm are out of engagement with the strip of bag closures.

In an embodiment, the elongated housing comprises a carrier frame for carrying the moving mechanism, and a strip receiving member arranged on the carrier frame and defining a strip guiding path with an insert end and an outlet end.

In an embodiment, the moving mechanism comprises a moving bridge at which the engaging arm is arranged, preferably rotatably, for moving at least the engaging arm in a direction substantially parallel to the guiding channel and between a first position at or near the dispensing position and a second position remote from the dispensing position in order to move the strip of bag closures in a direction extending between the first end and the second end of the elongated housing. During use, the moving bridge can be moved from the first position to the second position while the engaging arm is in the second position thereof, wherein the engaging arm is brought in the first position thereof when the moving bridge is at or near the second position thereof. After bringing the engaging arm into the first position, therewith engaging the strip of bag closures, the moving bridge is moved back towards the first position thereof, therewith moving the strip of bag closures through the guiding channel and towards the dispensing position.

In an embodiment, the moving mechanism comprises a drive for driving the moving bridge and/or for driving the engaging arm. In an embodiment thereof, the moving bridge is provided with a bridge driving opening configured for receiving the drive or a part thereof, and wherein the drive has a follower for driving the moving bridge, which follower is received within the bridge driving opening of the moving bridge. Preferably, the width of the bridge driving opening substantially corresponds to the diameter of the follower. In an embodiment thereof, the follower comprises one or more bearings arranged around the follower. Advantageously, the follower is used for driving the moving bridge while the one or more bearings reduce the friction which may arise when the follower, for example, the edges of the moving bridge defining the bridge driving opening.

Additionally, it is advantageous that a single drive can be used for driving the moving bridge between the first and second position thereof, and for driving the engaging arm between the first and second position thereof.

In an embodiment, the drive has a driving house and a driving axle, wherein, at the end of the driving axle facing away from the driving housing, an eccentric protrusion is provided extending radially outwards from the driving axle, wherein the follower is provided at the end of the eccentric protrusion facing away from the driving axle. An advantage of the drive is that the Scotch Yoke principle is applied, resulting in that the rotating motion of the drive axle can be converted into a, optionally linear, reciprocating motion of the moving bridge and/or of the engaging arm(s), while keeping the space required for the drive at a minimum.

In an embodiment, when the elongated housing comprises a carrier frame for carrying the moving mechanism, and a strip receiving member arranged on the carrier frame and defining a strip guiding path with an insert end and an outlet end, the carrier frame has a, preferably rectangular, frame body having a frame recess, wherein the moving bridge is arranged within the frame recess, at least partially.

In an embodiment, when the moving mechanism comprises two engaging arms, a first one of the two engaging arms has a base portion having an engaging side facing towards the second of the two engaging arms, a first engaging part at the engaging side of the base portion, an elongated engaging portion extending from the base portion in a direction parallel to the guiding channel, and a triangular engaging part extending towards the second of the two engaging arms at the end of the elongated engaging portion, and wherein the second of the two engaging arms has a base portion having an engaging side facing towards the first one of the two engaging arms, a second engaging part at the engaging side of the base portion configured to be in engagement with the first engaging part of the first one of the two engaging arms, an elongated engaging portion extending from the base portion in a direction parallel to the elongated engaging portion of the first one of the two engaging arms, a triangular engaging part extending towards the first one of the two engaging arms at the end of the elongated engaging portion, and a driving portion preferably extending away from the base portion thereof in a direction opposite to the elongated engaging portion. In an embodiment thereof, the base portion of each of the first and second engaging arms is provided with a convex side at the engaging side thereof. In an even further embodiment thereof, the first engaging part is an engaging notch and the second engaging part is an engaging protrusion configured for being received within the engaging notch in order to couple operatively the first and second engaging arms.

During use, the moving mechanism only has to apply a moving force to the second one of the two engaging arms in order to engage or to disengage the strip of bag closures, since movement of the second one of the two engaging arms is transferred to the first one of the two engaging arms by means of the engaging notch and the engaging protrusion being in engagement with each other. Additionally, the engaging side of each of the two engaging arms being a convex side allows rotational movement of the second one of the two engaging arms with respect to the first one of the two engaging arms, therewith keeping the construction used for transferring movement of the second one of the two engaging arms to the first one of the two engaging arms relatively simple.

In an embodiment, the driving portion broadens in a direction away from the base portion, and comprises an arm driving opening. In an embodiment thereof, the arm driving opening is located substantially above the bridge driving opening. Preferably the length of the arm driving opening is shorter than the length of the bridge driving opening. By moving the follower of the drive within the bridge driving opening over the whole length thereof, the follower will abut advantageously against the edge of the arm driving opening at one of the ends thereof, therewith moving the engaging arms into the first and or second position.

In an embodiment, the arm driving opening comprises a first driving opening portion and a second driving opening portion which are arranged at an angle with respect to each other. This construction of the arm driving opening facilitates movement of the follower through the arm driving opening over substantially the whole length thereof.

In an embodiment, the moving mechanism has a spacer plate with a space body, preferably made of a polymer, such as polyoxymethylene (POM), on which the engaging arm is arranged.

In an embodiment, the bag closure applying unit comprises a bag closure detecting device configured for detecting whether a bag closure is positioned within the dispensing position, and configured for triggering the moving mechanism to move the strip of bag closures through the guiding channel towards the dispensing position, when it is detected that no bag closure is present within the dispensing position. In an embodiment thereof, when the elongated housing comprises a carrier frame for carrying the moving mechanism, and a strip receiving member arranged on the carrier frame and defining a strip guiding path with an insert end and an outlet end, the bag closure detecting device comprises a detecting arm with a sensing part, arranged rotatably at the carrier frame between a first orientation, in which the sensing part abuts against a bag closure located at the dispensing position, and a second orientation, in which the sensing part is at least partially located at the dispensing position, and a sensor, such as a light lock, configured for sensing whether the detecting arm is in the first orientation or the second orientation, and for triggering the moving mechanism to move the strip of bag closures through the guiding channel to the dispensing position, when the detecting arm is in the second orientation. An advantage of this embodiment is that the moving mechanism moves the strip of bag closures towards and partially into the dispensing position, when it is determined that no bag closure is present at the dispensing position. Therefore, a bag closure is always ready to be applied to a bag to be closed.

In an embodiment, when the moving mechanism comprises a moving bridge at which the two engaging arms are arranged for moving at least the two engaging arms in a direction substantially parallel to the guiding channel and between a first position, at or near the dispensing position, and a second position, remote from the dispensing position, in order to move the strip of bag closures in a direction extending between the first end and the second end of the elongated housing, the bag closure applying unit comprises a moving bridge position determiner configured for determining whether the moving bridge is in the first position thereof, and configured for triggering the moving mechanism to move the moving bridge back into the first position, when it is determined that the moving bridge is not at the first position thereof. During use, the moving bridge performs a reciprocating movement between the first position and the second position thereof, in order to be able to move the strip of bag closure through the guiding channel, wherein movement of the moving bridge is stopped when the moving bridge returns in its first position and a following bag closure is placed at the dispensing position.

In an embodiment, the bag closure applying unit comprises a blocking member, such as a blocking nock, arranged within the guiding channel and configured for blocking the strip of bag closures to move through the guiding channel in a direction away from the dispensing position. For example, during use, the blocking member is configured such that a leading bag closure of the strip of bag closures is allowed to pass the blocking nock, whereafter the blocking nock prevents the subsequent bag closures from moving through the guiding channel. The engaging arm, subsequently, may force the leading bag closure into the dispensing position, therewith decoupling the leading bag closure from the remaining bag closures of the strip of bag closures.

In an embodiment, the bag closure applying unit comprises at least one protecting cover configured for at least partially covering the guiding channel of the housing.

According to a second aspect, the invention provides a bag closure device, comprising:

a frame configured for receiving a roll with a strip of bag closures; and a bag closure applying unit according to the first aspect of the invention, which bag closure applying unit is arranged at the frame The bag closure device has at least the same advantages as described in relation to the first aspect of the invention.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached drawings, in which.

DETAILED DESCRIPTION OF THE INVENTION

Figure 1:
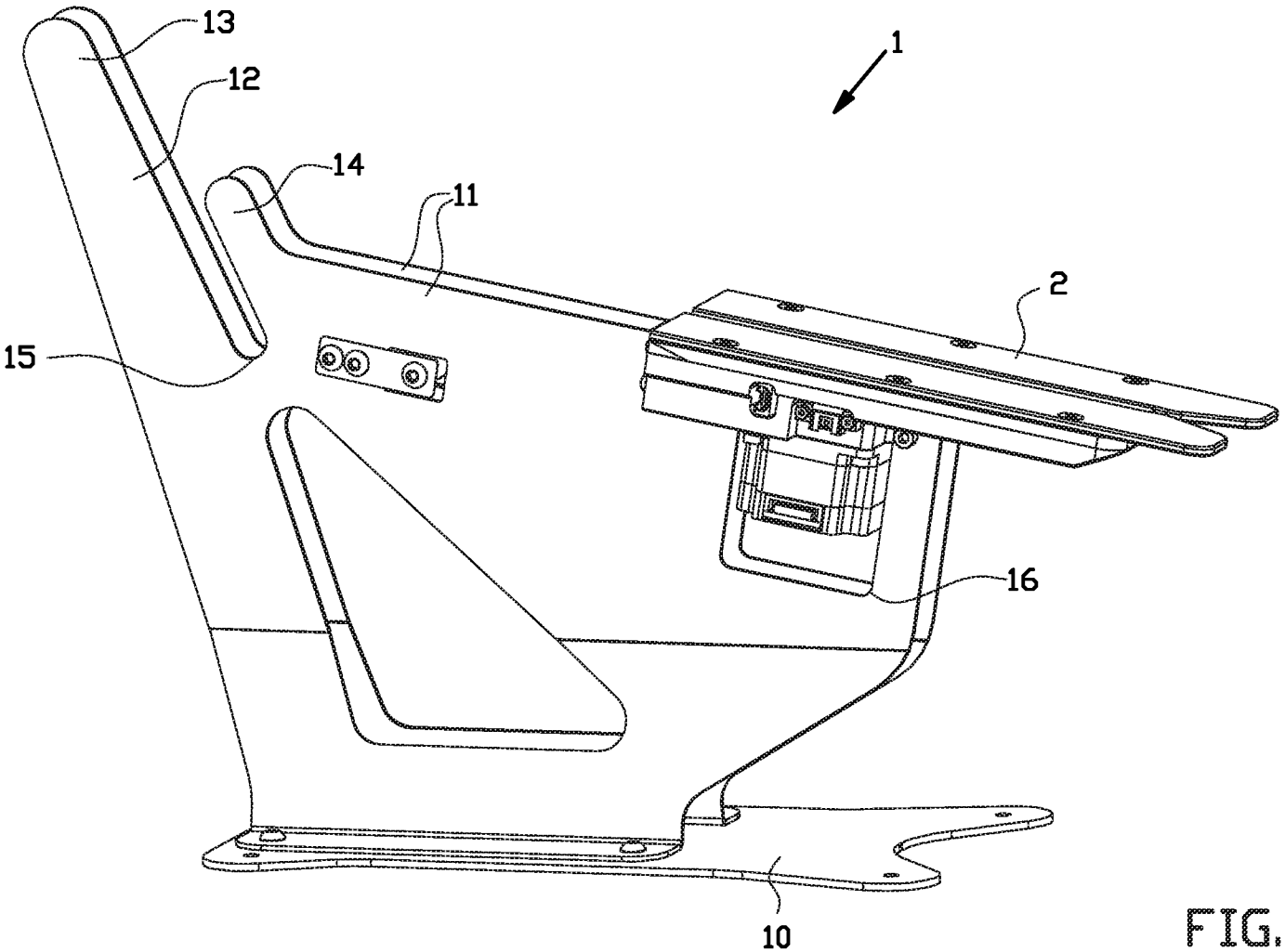
FIG. 1 shows an isometric view of the bag closure device having a bag closure applying unit according to an embodiment of the invention.

A bag closure device 1 for attaching a bag closure, such as a "Kwik Lok" type of bag closure, to a bag according to an embodiment of the invention is shown in FIG. 1. The bag closure device 1 comprises a support plate 10 for placing the bag closure device 1 on an underground, such as a table top. Two support legs 11 are arranged on top of the support plate 10, wherein each of the support legs 11 extends substantially perpendicular to the support plate 10. Each support leg 11, at one side thereof, is provided with a fork-shaped receiving portion 12 having a first tooth-shaped part 13 and a second tooth-shaped part 14 with a receiving recess 15 there between configured for receiving a roll containing a strip of bag closures. At the other side, each support leg 11 is provided with a receiving portion 16 configured for receiving a bag closure applying unit 2.

Figure 2:
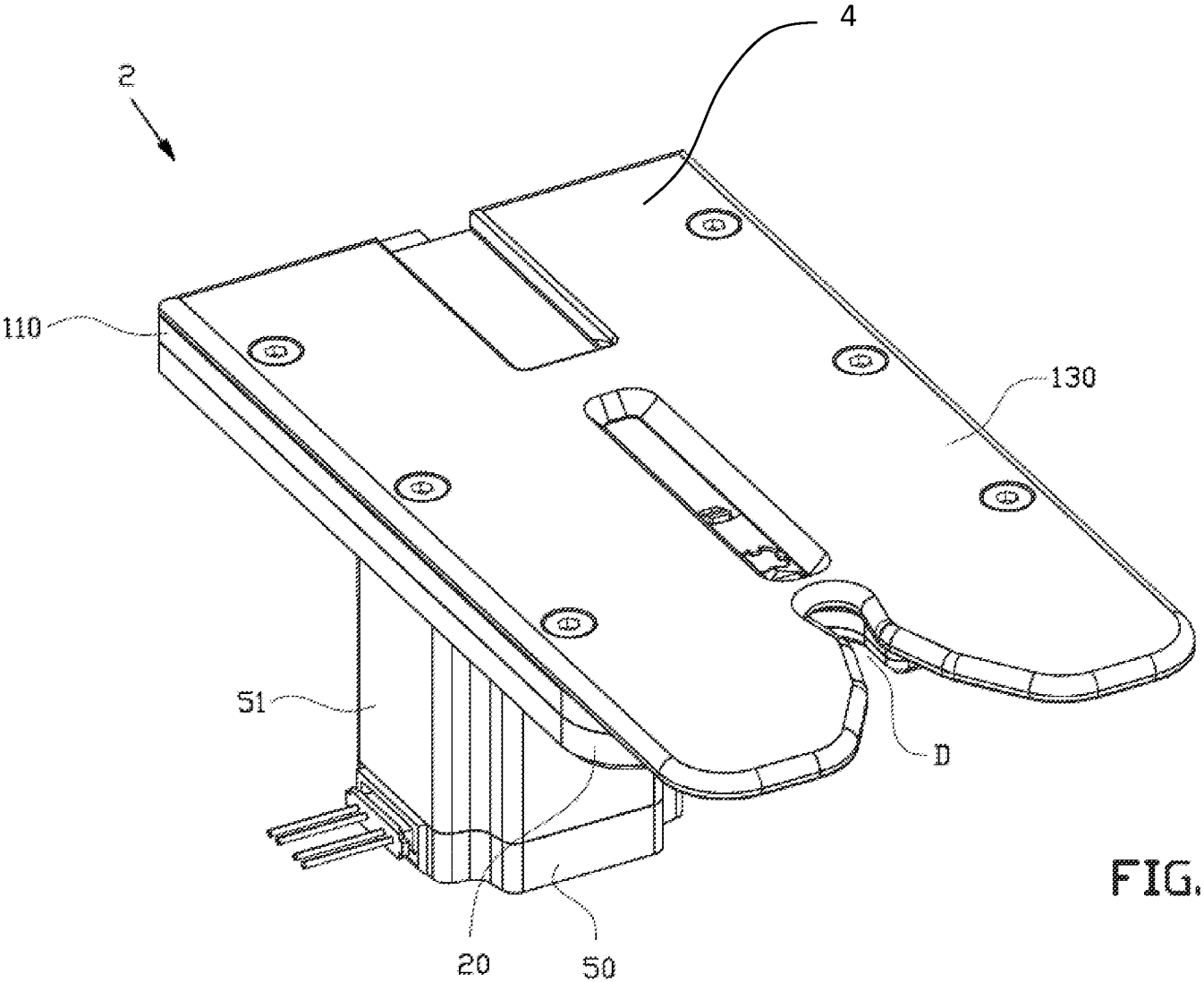
FIG. 2 shows an isometric view of the bag closure applying unit of FIG. 1.
Figure 3A:
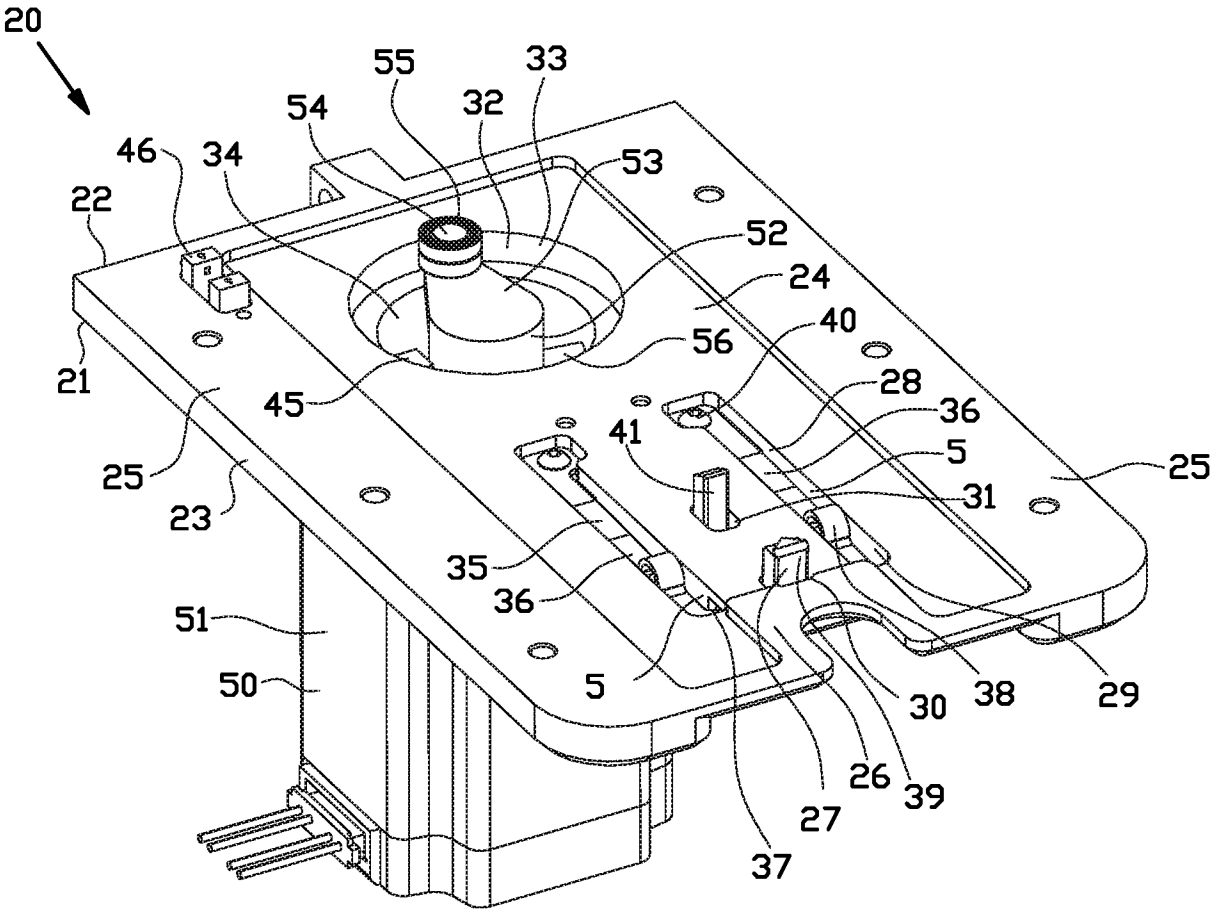
FIG. 3A shows an isometric view of the bag closure unit of FIG. 2 with protecting covers, strip receiving member and moving bridge removed.

An isometric view of the bag closure applying unit 2 is shown in FIG. 2. The bag closure applying unit 2 is provided with an elongated housing 4 with a carrier frame 20 having a bottom side 21 and a top side 22. As shown in FIG. 3A, in which an isometric view of the carrier frame 20 is shown, the carrier frame 20 has a substantially rectangular frame body 23. The frame body 23 has a frame recess 24 with a recess depth being formed in such manner, that borders 25 are formed along the longitudinal and transverse sides of the frame body 23. Additionally, at one end of the frame body 23, when viewed in the longitudinal direction thereof, a bag neck receiving portion 26, in longitudinal direction downstream of which an active blocking member 27 is arranged, is provided extending from the respective border 25 into the frame recess 24 in a direction substantially parallel to the longitudinal direction of the carrier frame 20.

As shown in FIG. 3A, the frame recess 24 comprises two parallel receiving slits 5, each having a first slit portion 28 being a recessed portion, and a second slit portion 29 being a through portion. The frame recess 24 further has a first through hole 30 and a second through hole 31. Additionally, the frame recess 24 is provided with a driving hole 32 having a first hole portion 33 with a first diameter, and a second hole portion 34 with a second diameter, wherein the first diameter is larger than the second diameter.

As shown in FIG. 3A, the active blocking member 27 comprises a U-shaped blocking body 35 having two substantially parallel legs 36 and a base member 37 connecting the two legs 36. Each of the legs 36 is made of a resilient material and is provided with a bulge 38 extending substantially upwards from the respective leg 36 and at least partially into the frame recess 24. The base member 37 is provided with a blocking nock 39 extending substantially upwards therefrom. As shown in FIG. 3A, the legs 36 of the active blocking member 26 are situated within the receiving slits 5 and the legs 36 are fixed at the first slit portion 28 by means of a fixing member 40, such as a fixing screw. The base member 37 of the active blocking member 27 is situated at the bottom side 21 of the carrier frame 20 and the blocking nock 39 extends through the first through hole 30 for blocking a strip of bag closures. Furthermore, as shown in FIG. 3A, a passive blocking nock 41 extending through the second through hole 31 and being fixed to the bottom side of the carrier frame 20 is provided.

A first light lock 45 is provided partially within the driving hole 32, in particular within the second hole portion 34, in such a manner that the sensing part of the first light lock 45 extends into the driving hole 32. Additionally, a second light lock 46 is provided within one of the borders 25 of the carrier frame 20, wherein the sensing part of the second light lock 46 is orientated upwards.

The bag closure applying unit 2 further comprises a drive 50, such as a stepper motor, for example based on Scotch Yoke, having a driving housing 51 and a driving axle 52 extending therefrom. As shown in FIG. 3A, the driving housing 51 is arranged at the bottom side 21 of the carrier frame 20, wherein the driving axle 52 extends through the circular driving hole 32. At the end of the driving axle 52 facing away from the driving housing 51, an eccentric protrusion 53 is provided extending radially outwards from the driving axle 52. As shown in FIG. 3A, the length of the eccentric protrusion 53 substantially corresponds to the half of the first diameter, also called the radius, of the first hole portion 33. A follower 54 has been provided at the end of the eccentric protrusion 53 facing away from the driving axle 51, which follower 54 extends substantially upwards, i.e. in a direction substantially parallel to the longitudinal direction of the driving axle 51. Two bearings 55 are provided around the follower 54, wherein one of the bearings 55 is configured for abutting against the inner circumference of the first hole portion 33.

Furthermore, the driving axle 52 is provided with a sensing rod 56 extending radially outwardly therefrom. The sensing rod 56 follows the rotational movement of the driving axle 52, therewith being moved towards or away from the first light lock 45. Cooperation of the sensing rod 56 and the first light lock 45 is used for determining the position of the driving axle 52 and thus of the follower 54.

Figure 3B:
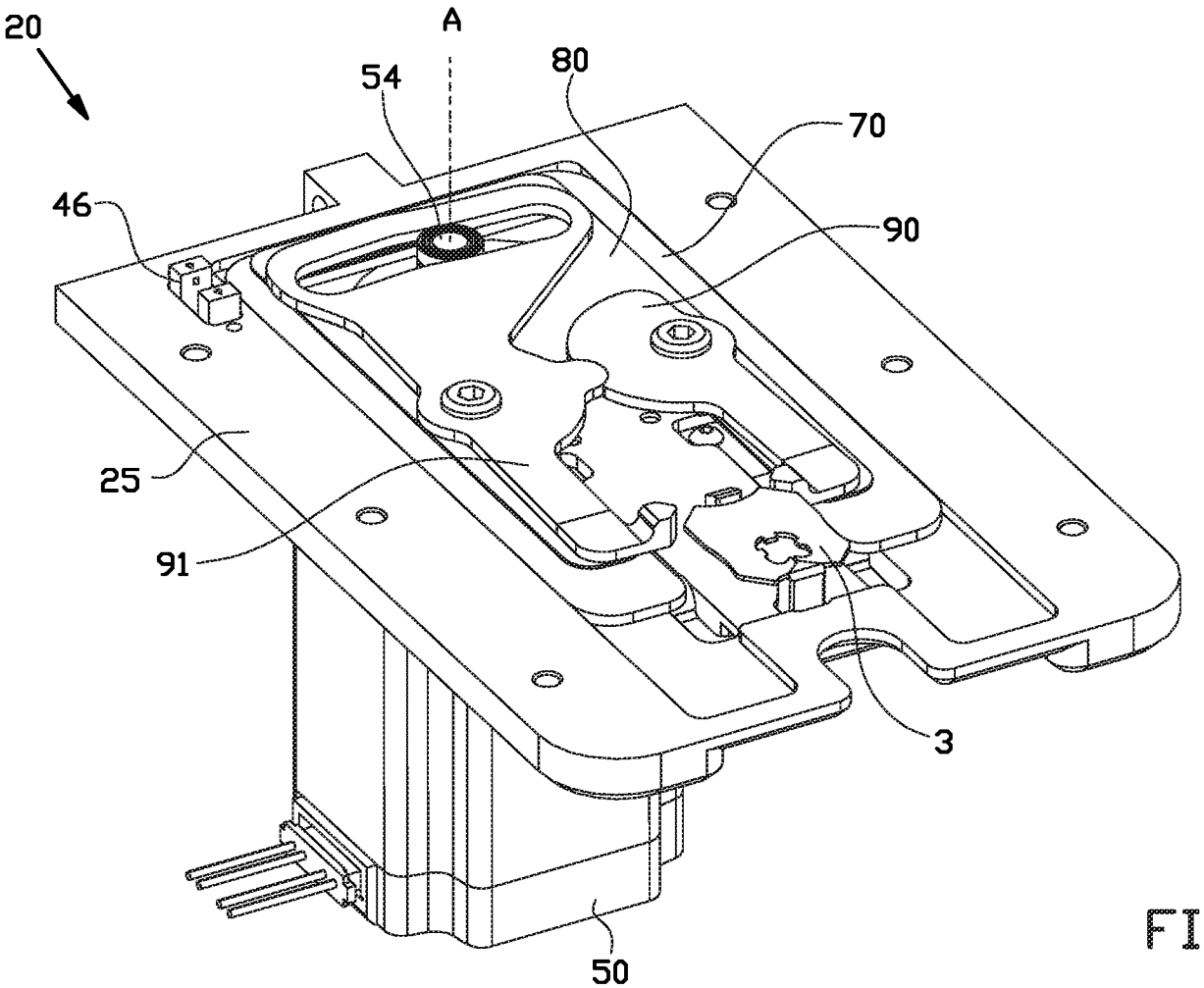
FIG. 3B shows an isometric view of the bag closure unit of FIG. 3A with the moving bridge.

As shown in FIG. 3B, the bag closure applying unit 2 further comprises a moving bridge 70 which is arranged within the frame recess 24. As shown in more detail in FIG. 3C, the moving bridge 70 has an elongated bridge body 71 with a bridge driving opening 72 provided therein. The driving opening 72 is configured to receive the follower 54 having the two bearings 55 arranged around, such that rotational movement of the follower 52 around the rotation axis A causes the moving bridge 70 to move back and forth in a direction B, C parallel to the longitudinal axis of the carrier frame 20 and between a first position at or near the dispensing position and a second position remote from the dispensing position. The width of the bridge driving opening 72 substantially corresponds to the bearing diameter of each of the bearings 55. The elongated bridge body 71 further has a first bridge end 73 and a second bridge end 74, opposite to the first bridge end 73. At the first bridge end 73, the elongated bridge body 71 is provided with two arm-like protrusions 75 extending parallel to each other and to the longitudinal direction of the carrier frame 20. A bridge receiving space 76 is defined between the two arm-like protrusions 75, which bridge receiving space 76 is configured for receiving among others the bag neck receiving member 26, the active blocking member 27 and the passive blocking nock 41. As shown in FIG. 3B, the length of the moving bridge 70 is shorter than the length of the frame recess 24.

Furthermore, each of the two arm-like protrusions 75 comprises, at the end facing away from the first bridge end 73, a first arm portion 77 having a first width in a direction transverse to the longitudinal direction of the moving bridge 70, and, at the end facing the first bridge end 73, a second arm portion 78 having a second width in a direction transverse to the longitudinal direction of the moving bridge 70, wherein the second width is larger than the first width.

On top of the moving bridge 70, a spacer plate 80 having a spacer body 81 made of a polymer, such as polyoxymethylene (POM), is provided. The spacer body 81 has a first spacer end 82 and a second spacer end 83, opposite to the first spacer end 82 in the longitudinal direction. The spacer body 81 is provided with two arm-like spacer protrusions 84 at the first spacer end 82 placed on top of the arm-like protrusions 75 of the moving bridge. The spacer body 81 has a spacer driving opening 85 for allowing the follower 54 with the bearings 55 to pass there through.

Figure 3C:
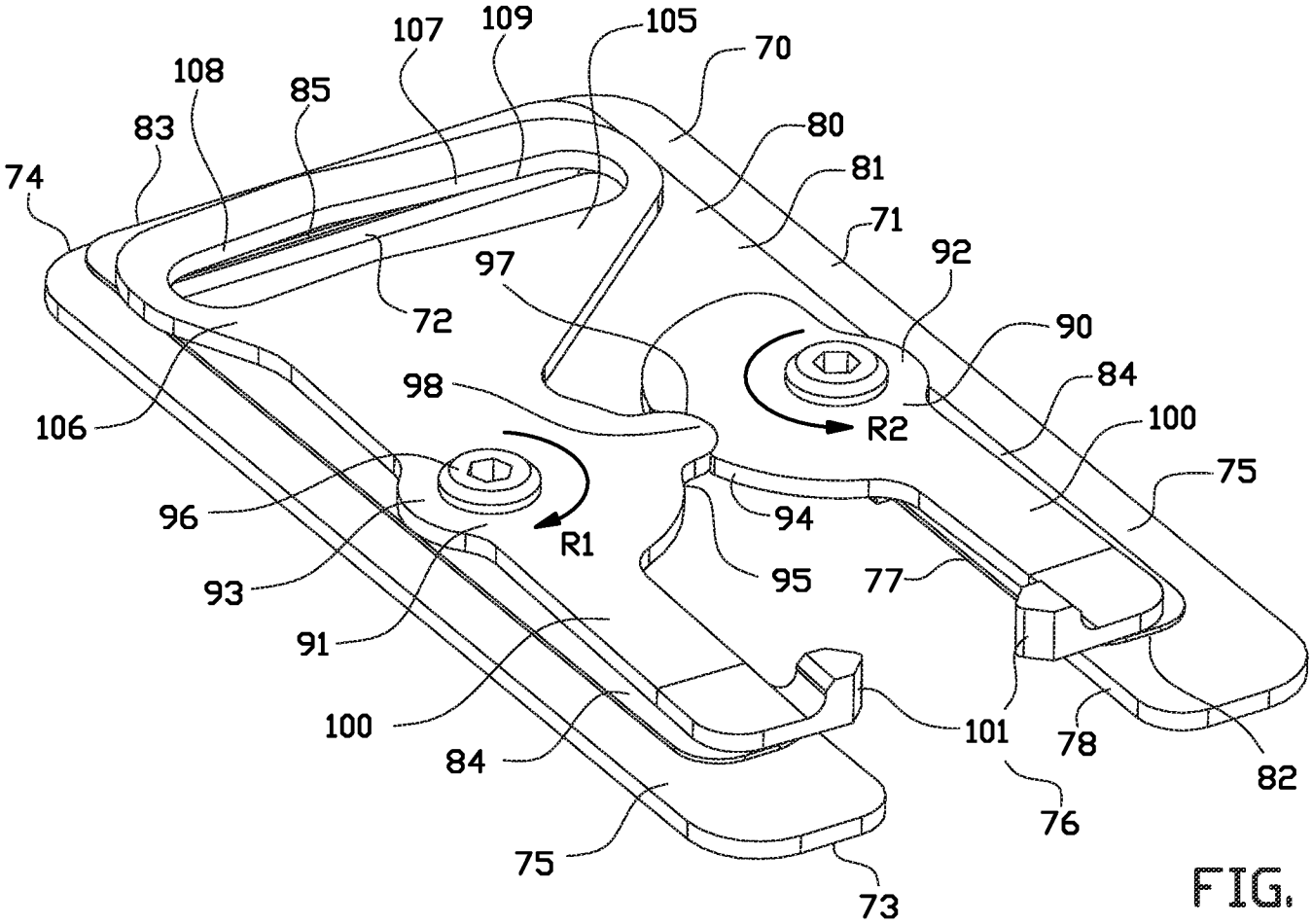
FIG. 3C shows an isometric view of the moving bridge.

As shown in FIGS. 3B and 3C, the moving bridge 70 further comprises a first engaging arm 90 and a second engaging arm 91 which are operatively connected to each other. Each of the first engaging arm 90 and the second engaging arm 91 is provided with a base portion 92, 93 having a convex side 94, 95 facing towards the other one of the first and second engaging arms 90, 91 and having a non-shown securing through hole for securing the respective engaging arm 90, 91 rotatably to the spacer plate 80 and to the moving bridge 70 by means of securing members 96, in this case securing screws. As shown in FIG. 3B, the first and second engaging arms 90, 91 are secured to the moving bridge 70 at a location between the bridge driving opening 72 and the protrusions 75. The first engaging arm 90 is provided with an engaging part 97 at the convex side 94 thereof facing towards the second engaging arm 91. In this embodiment, engaging part 97 is provided as an engaging notch. The second engaging arm 91 is provided with an engaging protrusion 98 at the convex side 95 thereof facing towards the first engaging arm 90. The engaging protrusion 98 is received within the engaging part 97 in order to couple operatively the first and second engaging arms 90, 91. As a result, rotation of the second engaging arm 91 around a first arm rotation axis defined by the respective securing member 96, as indicated by arrow R1, causes the first engaging arm 90 to rotate around a second arm rotation axis, as indicated with arrow R2, defined by the respective securing member 96 thereof.

Each of the first and second engaging arms 90, 91 is provided with an elongated engaging portion 100 extending from the base portion 92, 93 substantially parallel to the respective protrusion 75 of the moving bridge 70 above which the respective engaging portion 100 is located. At the end of the respective elongated engaging 100, the respective engaging portion 100 is provided with a triangular engaging part 101 extending towards the other one of the elongated engaging portions 100. Each of the triangular engaging parts 101 is configured for being inserted into a triangular shaped indentation in each of the longitudinal sides of a strip of bag closures at each transition between subsequent bag closures 3.

The second engaging arm 91 further comprises a driving portion 106 extending away from the base portion 93 thereof towards the second bridge end 74, i.e. in a direction opposite to the elongated engaging portion 100 thereof, thereby being broadened. At the end of the driving portion 105 of the second engaging arm 101, i.e. the broadest part of the driving portion 106, facing away from the base portion 93, an arm driving opening 107 has been provided. As schematically indicated in FIG. 3C, the length of the arm driving opening 107 may be shorter than the length of the bridge driving opening 72 and the spacer driving opening 85. The arm driving opening 107 is configured for receiving the follower 54 with the bearings 55, such that rotational movement of the follower 74 around the rotation axis A causes the second engaging arm 91 to rotate around the first arm rotation axis, therewith rotating the first engaging arm 90 around the second arm rotation axis. As shown in FIG. 3C, the arm driving opening 107 has a first driving opening portion 108 and a second driving opening portion 109 which are arranged at an angle with respect to each other, therewith contributing to the movement of the second engaging arm 91 around the second rotation axis.

Figure 3D:
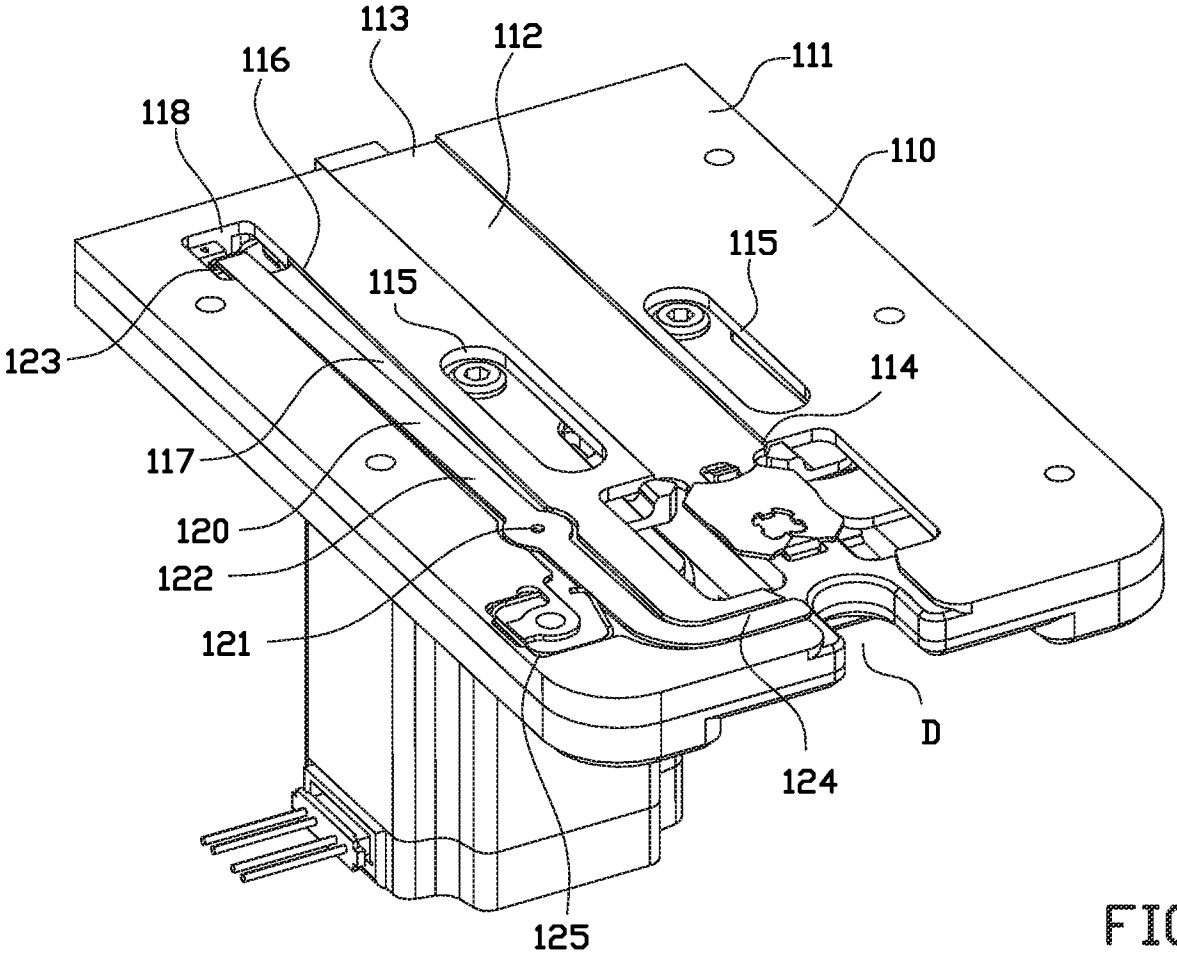
FIG. 3D shows the bag closure applying unit of FIG. 3B with the strip receiving member.

FIG. 3D shows that a strip receiving member 110 is arranged at the top side 22 of the carrier frame 20. The strip receiving member 110 has a strip receiving body 111 having a top side and a bottom side. The strip receiving body 111 defines a strip guiding path 112, defining a guiding channel, having an insert end 113 and an outlet end 114 from which the bag closures 3 are moved towards the dispensing position D.

The strip receiving body 111 is further provided with two elongated guiding recesses 115, provided on each side of the strip guiding path 112 and configured for receiving and guiding the securing members 96. Furthermore, the strip receiving body 111 is provided with a receiving recess 116 having a recessed portion 117 and a through portion 118 located above the second light lock 46. As shown in FIG. 3D, a detecting arm 120 is arranged within the receiving recess 116 of the strip receiving member 110. The detecting arm 120 is arranged rotatably around a securing pin 121. The detecting arm 120 has a first elongated detecting arm part 122 extending in a direction substantially parallel to the longitudinal direction of the carrier frame 20. The elongated detecting arm part 122 has a first end and a second end, opposite to the first end in the longitudinal direction thereof, wherein the second end is located at or near the second light lock 46. At the first end, the elongated detecting arm part 122 is provided with a sensing part 124 orientated substantially perpendicular to the elongated detecting arm part 122 and towards the longitudinal axis of the carrier frame 20, in particular a dispensing position D of the bag closure applying unit 2 where the bag closure 3 is applied to a non-shown bag. At the second end, the elongated detecting arm part 122 is provided with a blocking part 123 extending downwards in the direction of the second light lock 46.

As shown in FIG. 3D, a biasing spring 125 is arranged beside the elongated arm part 122 and configured for biasing the sensing part 124 towards the dispensing position D. When a bag closure 3 is arranged at the dispensing position D, the sensing part 124 abuts against the respective bag closure 3 and the blocking part 123 is not detected by the second light lock 46. When no bag closure 3 is arranged at the dispensing position D, the sensing part 124 is forced into the dispensing position D at least partially and the blocking part 123 is detected by the second light lock 46, therewith triggering movement of the moving bridge 70, as is elucidated below. The detector arm 120 and the second light lock 46 form a bag closure detecting device.

As shown in FIG. 2, the strip guiding path 112 is closed off partially by a protecting cover 130. Near the dispensing position D, the protecting cover 130 defines an outwardly diverging guiding channel for guiding a non-shown bag towards the dispensing position D.

During use a bag is brought into the dispensing position D in order to apply a bag closure 3 to the bag. When the bag closure 3 is removed from the dispensing position D, the detecting arm 120, in particular the sensing part 124 thereof, is forced partially into the dispensing position D, therewith moving the blocking part 123 in front of the second light lock 46. As a result, the drive 50 is triggered to start rotating the driving axle 52, therewith moving the follower 54 with the bearings 55. By moving the follower 54, one of the bearings 55 abuts against the edges of the bridge driving opening 72, the spacer driving opening 85 and the arm driving opening 107, in particular the first driving opening portion 108 thereof, resulting in that the moving bridge 70 is moved in a direction parallel to the longitudinal direction of the carrier frame 20 and away from the dispensing position D. Simultaneously, the second arm portions 78 of the arm-like protrusions 75 exert a force to the bulges 38 of the active blocking member 27, therewith pushing the active blocking member 27 downwards. Subsequently, the follower 54 moves from the first driving opening portion 108 to the second driving opening portion 109 and the follower 54 will move towards an end of the arm driving opening 107. As a result, the first and second engaging arms 90, 91 are rotated around their respective rotation axis, such that the triangular engaging parts 101 are moved away from each other, corresponding to the second position. The triangular engaging parts 101 are moved along the strip of bag closures 3 in the direction indicated with arrow C, while the strip of bag closures 3 is maintained in the position thereof by the active blocking member 27 and the passive blocking nock 41, until the moving bridge 70 start moving in the opposite direction as indicated with arrow B. At that point, the triangular engaging parts 101 are moved towards each other by the follower 54 moving towards the other end of the arm driving opening, such that the triangular engaging parts 101 are positioned within indentations in each of the longitudinal sides of the strip of bag closures 3 at a transition between subsequent bag closures 3, therewith clamping the strip of bag closures 3. While moving the moving bridge 70 and the first and second engaging arms 90, 91 towards the dispensing position D, the strip of bag closures 3 is also moved in order to arrange a following bag closure 3 into the dispensing position D. Just before the following bag closure 3 is arranged in the dispensing position D, the bulges 38 of the active blocking member 27 are released by the second arm portions 78 of the arm-like protrusions 75, as the bulges 38 become situated along the first arm portions 77. As a result, the active blocking member 27 moves upwards and is placed between two subsequent bag closures 3. Subsequently, the following bag closure 3 is arranged in the dispensing position D by the first and second engaging arms 90, 91 moving slightly further towards the dispensing position D, therewith disconnecting the bag closure 3 from the subsequent bag closure 3. At this point, the first light lock 45 detects the sensing rod 56 and the drive 50 is switched off. The first light lock 45 forms a moving bridge position determiner.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. A bag closure applying unit for attaching a bag closure to a bag, the bag closure applying unit comprising:

an elongated housing having a first end and a second end, opposite to the first end, and a guiding channel extending between the first end and the second end and ending at or in a dispensing position for dispensing a bag closure, wherein the guiding channel is configured for receiving a strip of bag closures; and a moving mechanism configured for engaging the strip of bag closures and for moving the strip of bag closures through the guiding channel towards the dispensing position, wherein the moving mechanism comprises an engaging arm for engaging the strip of bag closures, wherein the engaging arm is configured to engage the strip of bag closures at an outer contact surface provided on a perimeter of a longitudinal side of the strip of bag closures.

2. The bag closure applying unit according to claim 1, wherein the moving mechanism comprises two engaging arms.

3. The bag closure applying unit according to claim 2, wherein the two engaging arms are configured to be moved between a first position, in which the two engaging arms have engaged the strip of bag closures, and a second position, in which the two engaging arms are out of engagement with the strip of bag closures.

4. The bag closure applying unit according to claim 1, wherein the elongated housing comprises a carrier frame for carrying the moving mechanism, and a strip receiving member arranged on the carrier frame and defining a strip guiding path with an insert end and an outlet end.

5. The bag closure applying unit according to claim 1, wherein the moving mechanism comprises a moving bridge at which the engaging arm is arranged for moving at least the engaging arm in a direction substantially parallel to the guiding channel and between a first position at or near the dispensing position and a second position remote from the dispensing position in order to move the strip of bag closures in a direction extending between the first end and the second end of the elongated housing.

6. The bag closure applying unit according to claim 5, wherein the moving mechanism comprises a drive for driving the moving bridge and/or for driving the engaging arm.

7. The bag closure applying unit according to claim 6, wherein the moving bridge is provided with a bridge driving opening configured for receiving the drive or a part thereof, and wherein the drive has a follower for driving the moving bridge, which follower is received within the bridge driving opening of the moving bridge.

8. The bag closure applying unit according to claim 7, wherein the follower comprises one or more bearings arranged around the follower.

9. The bag closure applying unit according to claim 7, wherein the drive has a driving house and a driving axle, wherein, at the end of the driving axle facing away from the driving housing, an eccentric protrusion is provided extending radially outwards from the driving axle, wherein the follower is provided at the end of the eccentric protrusion facing away from the driving axle.

10. The bag closure applying unit according to claim 7, wherein the elongated housing comprises a carrier frame for carrying the moving mechanism, and a strip receiving member arranged on the carrier frame and defining a strip guiding path with an insert end and an outlet end, and wherein the carrier frame has a frame body having a frame recess, wherein the moving bridge is arranged within the frame recess, at least partially.

11. The bag closure applying unit according to claim 2, wherein a first one of the two engaging arms has a base portion having an engaging side facing towards the second of the two engaging arms, a first engaging part at the engaging side of the base portion, an elongated engaging portion extending from the base portion in a direction parallel to the guiding channel, and a triangular engaging part extending towards the second of the two engaging arms at the end of the elongated engaging portion, and wherein the second of the two engaging arms has a base portion having an engaging side facing towards the first one of the two engaging arms, a second engaging part at the engaging side of the base portion configured to be in engagement with the first engaging part of the first one of the two engaging arms, an elongated engaging portion extending from the base portion in a direction parallel to elongated engaging portion of the first one of the two engaging arms, a triangular engaging part extending towards the first one of the two engaging arms at the end of the elongated engaging portion, and a driving portion extending away from the base portion thereof in a direction opposite to the elongated engaging portion.

12. The bag closure applying unit according to claim 11, wherein the base portion of each of the two engaging arms is provided with a convex side at the engaging side thereof.

13. The bag closure applying unit according to claim 11, wherein the first engaging part is an engaging notch and the second engaging part is an engaging protrusion configured for being received within the engaging notch in order to couple operatively the two engaging arms.

14. The bag closure applying unit according to claim 11, wherein the driving portion broadens in a direction away from the base portion, and comprises an arm driving opening.

15. The bag closure applying unit according to claim 7, wherein the driving portion broadens in a direction away from the base portion, and comprises an arm driving opening wherein the arm driving opening is located substantially above the bridge driving opening.

16. The bag closure applying unit according to claim 14, wherein the arm driving opening comprises a first driving opening portion and a second driving opening portion which are arranged at an angle with respect to each other.

17. The bag closure applying unit according to claim 1, wherein the moving mechanism has a spacer plate with a spacer body made from a polymer on which the engaging arm is arranged.

18. The bag closure applying unit according to claim 1, comprising a bag closure detecting device configured for detecting whether a bag closure is positioned within the dispensing position, and configured for triggering the moving mechanism to move the strip of bag closures through the guiding channel towards the dispensing position, when it is detected that no bag closure is present within the dispensing position.

19. The bag closure applying unit according to claim 18, wherein the elongated housing comprises a carrier frame for carrying the moving mechanism, and a strip receiving member arranged on the carrier frame and defining a strip guiding path with an insert end and an outlet end, wherein the bag closure detecting device comprises a detecting arm with a sensing part, arranged rotatably at the carrier frame between a first orientation, in which the sensing part abuts against a bag closure located at the dispensing position, and a second orientation, in which the sensing part is at least partially located at the dispensing position, and a sensor configured for sensing whether the detecting arm is in the first orientation or the second orientation, and for triggering the moving mechanism to move the strip of bag closures through the guiding channel to the dispensing position, when the detecting arm is in the second orientation.

20. The bag closure applying unit according to claim 5, comprising a moving bridge position determiner configured for determining whether the moving bridge is in the first position thereof, and configured for triggering the moving mechanism to move the moving bridge back into the first position, when it is determined that the moving bridge is not at the first position thereof.

21. The bag closure applying unit according to claim 1, comprising a blocking member arranged within the guiding channel and configured for blocking the strip of bag closures to move through the guiding channel in a direction away from the dispensing position.

22. The bag closure applying unit according to claim 1, comprising at least one protecting cover configured for at least partially covering the guiding channel of the housing.

23. A bag closure device comprising:

a frame configured for receiving a roll with a strip of bag closures; and a bag closure applying unit according to claim 1, which bag closure applying unit is arranged at the frame.

24. The bag closure applying unit according to claim 1, wherein the engaging arm is configured to engage the strip of bag closures at an indentation provided on the outer contact surface of the longitudinal side of the strip of bag closures.

25. The bag closure applying unit according to claim 1, wherein the engaging arm is configured to engage the strip of bag closures at an indentation provided on the outer contact surface of the longitudinal side of the strip of bag closures, the indentation being provided at a transition between consecutive bag closures including a first bag closure and a second bag closure.

26. The bag closure applying unit according to claim 1, wherein the engaging arm includes an engaging part having an engaging shape, the engaging part being configured to engage the strip of bag closures at an indentation provided on the outer contact surface of the longitudinal side of the strip of bag closures, indentation having a shape corresponding to the engaging shape of the engaging part.

27. The bag closure applying unit according to claim 1, wherein the engaging arm includes a triangular engaging part configured to engage the strip of bag closures at a triangular-shaped indentation provided on the outer contact surface of the longitudinal side of the strip of bag closures, the indentation being defined by the outer contact surface of the strip of bag closures.

28. The bag closure applying unit according to claim 1, wherein the engaging arm includes a first triangular engaging part configured to engage the strip of bag closures at a triangular-shaped indentation provided on the outer contact surface of the longitudinal side of the strip of bag closures, the indentation being defined by the outer contact surface of the strip of bag closures, wherein the moving mechanism comprises a second engaging arm that includes a second triangular engaging part configured to engage the strip of bag closures at a second triangular-shaped indentation provided on the outer contact surface of a second longitudinal side of the strip of bag closures, the second triangular-shaped indentation being provided on an opposite side of the strip of bag closures from the first triangular engaging part, each of the first indentation and the second indentation respectively being defined by the outer contact surface of the strip of bag closures, and wherein the first triangular engaging part opposes the second triangular engaging part across a path that the strip of bag closures is moved toward the dispensing position.

* * * * *